US007736112B2

(12) United States Patent
Davies

(10) Patent No.: US 7,736,112 B2
(45) Date of Patent: Jun. 15, 2010

(54) DOUBLE SEAM MONITOR

(75) Inventor: Mark Ian Davies, Childrey (GB)

(73) Assignee: Crown Packaging Technology, Inc., Alsip, IL (US)

( * ) Notice: Subject to any disclaimer, the term of this patent is extended or adjusted under 35 U.S.C. 154(b) by 100 days.

(21) Appl. No.: 11/816,864

(22) PCT Filed: Jan. 17, 2006

(86) PCT No.: PCT/EP2006/050238

§ 371 (c)(1),
(2), (4) Date: Sep. 21, 2007

(87) PCT Pub. No.: WO2006/125680

PCT Pub. Date: Nov. 30, 2006

(65) Prior Publication Data

US 2008/0253864 A1 Oct. 16, 2008

(30) Foreign Application Priority Data

Feb. 25, 2005 (EP) ..... 05101452

(51) Int. Cl.
*B21D 51/32* (2006.01)

(52) U.S. Cl. ..... 413/6; 413/31; 413/41

(58) Field of Classification Search ..... 413/69, 413/70, 74, 2, 4–7, 27, 31, 40, 41; 72/20.4, 72/21.4, 452.1–452.9

See application file for complete search history.

(56) References Cited

U.S. PATENT DOCUMENTS

| | | | | |
|---|---|---|---|---|
| 4,600,347 | A * | 7/1986 | Segredo et al. | 413/26 |
| 5,027,580 | A * | 7/1991 | Hymes et al. | 53/366 |
| 5,860,782 | A * | 1/1999 | Campbell | 413/6 |
| 6,575,683 | B2 * | 6/2003 | Buisson | 413/26 |
| 6,623,230 | B1 * | 9/2003 | Bagheri et al. | 413/4 |

FOREIGN PATENT DOCUMENTS

GB 2 310 043 A 8/1997

* cited by examiner

*Primary Examiner*—Dana Ross
*Assistant Examiner*—Stephanie Jennings
(74) *Attorney, Agent, or Firm*—Woodcock Washburn LLP

(57) ABSTRACT

An apparatus for monitoring the quality of a double seam used in can manufacture, or can filling, to seam a can end (2) onto a can body (1). The apparatus uses a device (41) for measuring the strain/force applied by the lifter cam (10) so as to provide information such as first operation seam quality, gross seam defects and machine condition.

17 Claims, 6 Drawing Sheets

[Fig. 001]
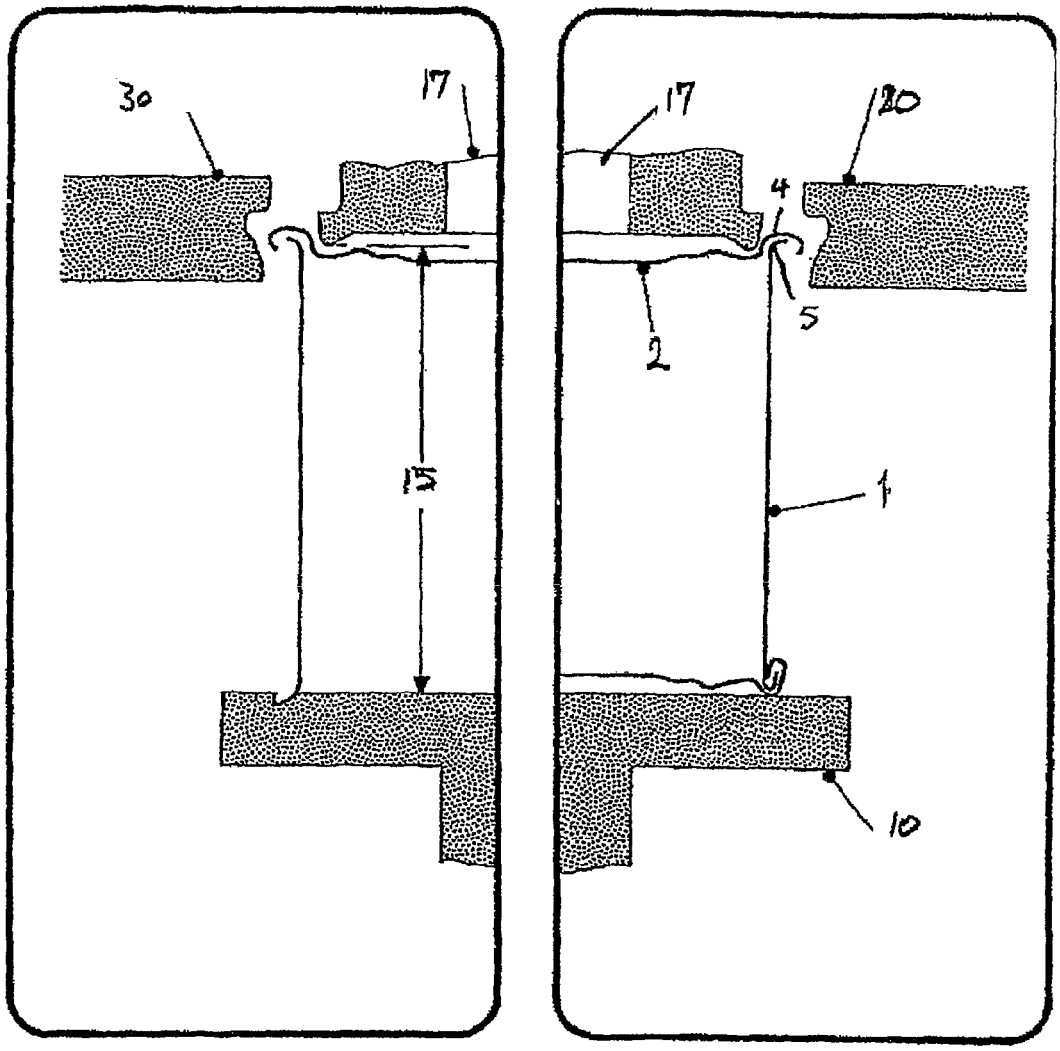

[Fig. 002]
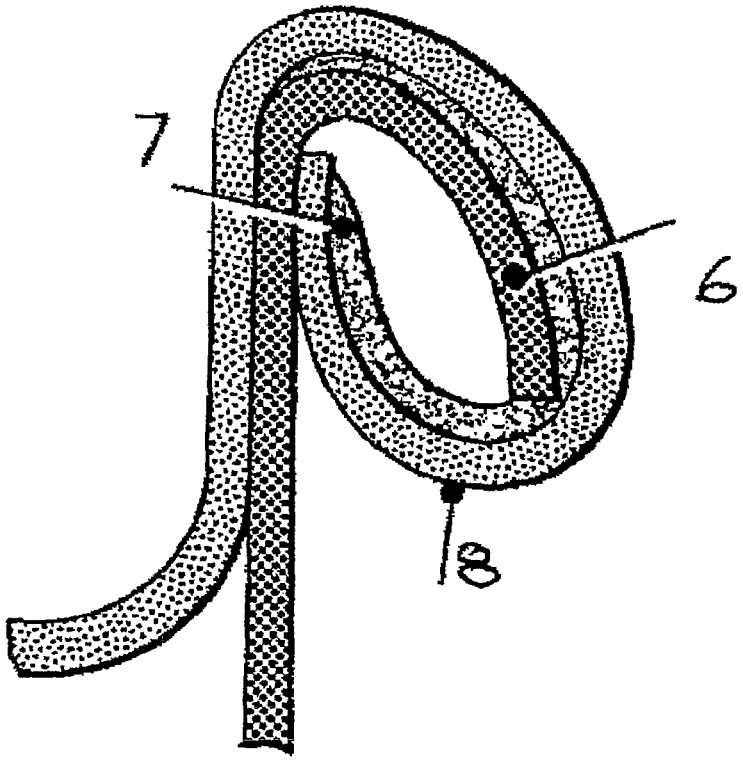
[Fig. 003]
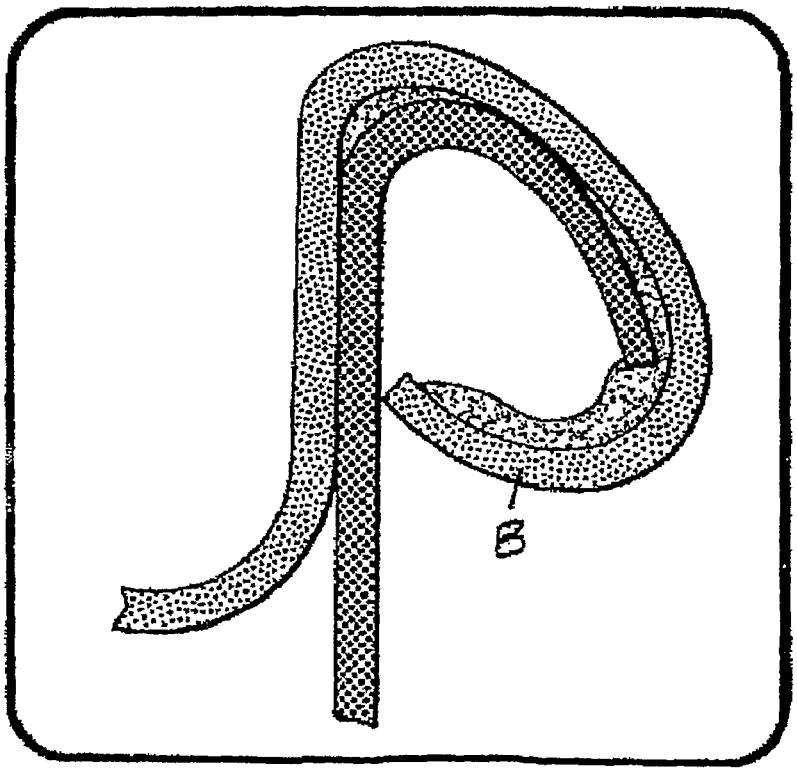

[Fig. 004]
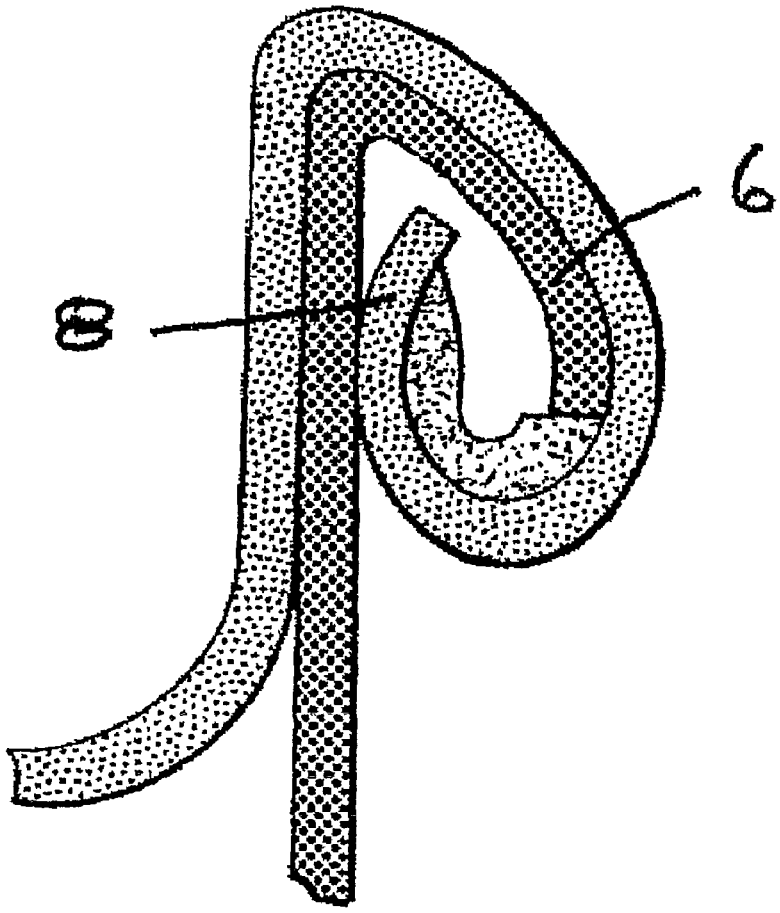
[Fig. 005]
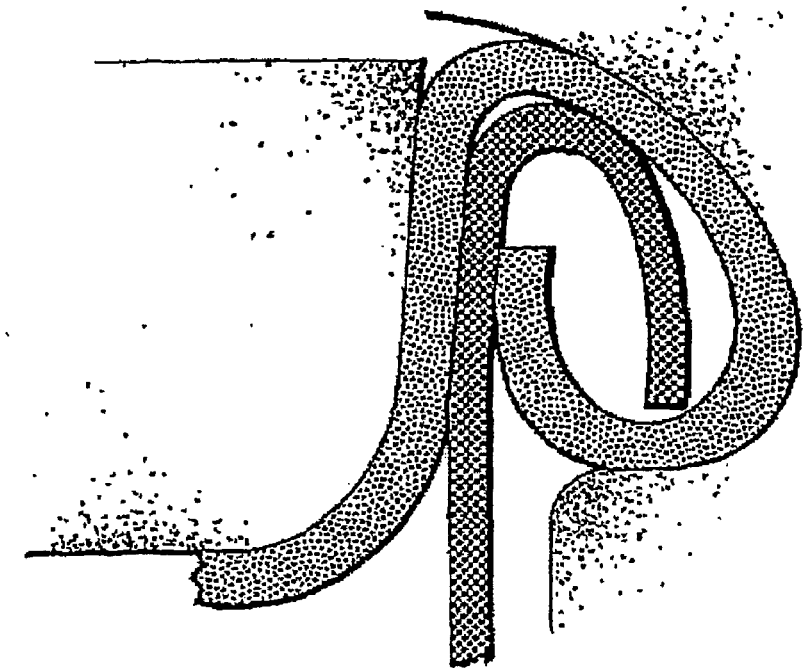

[Fig. 006]
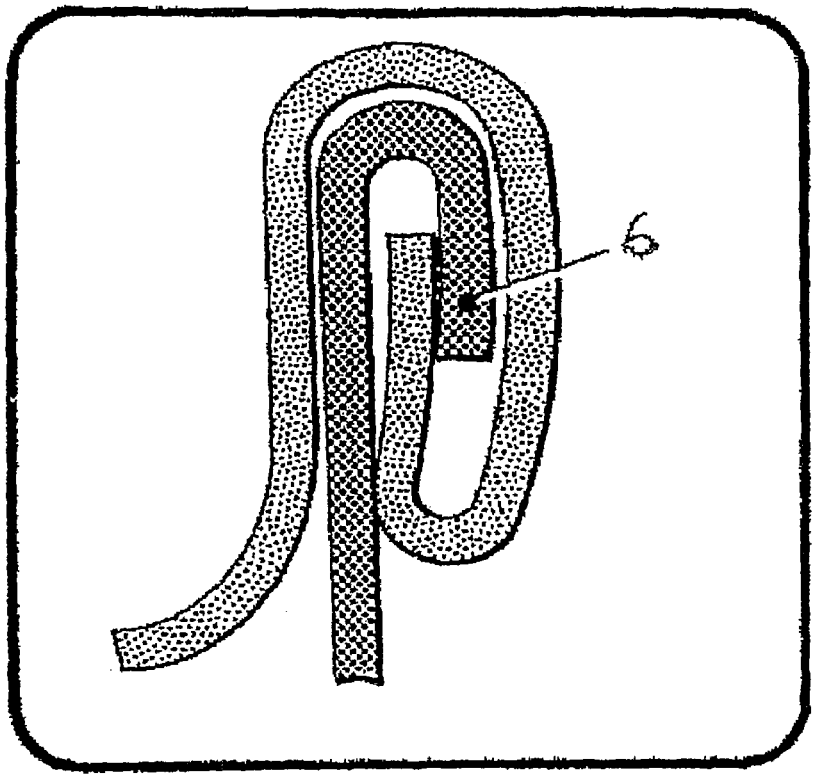
[Fig. 007]
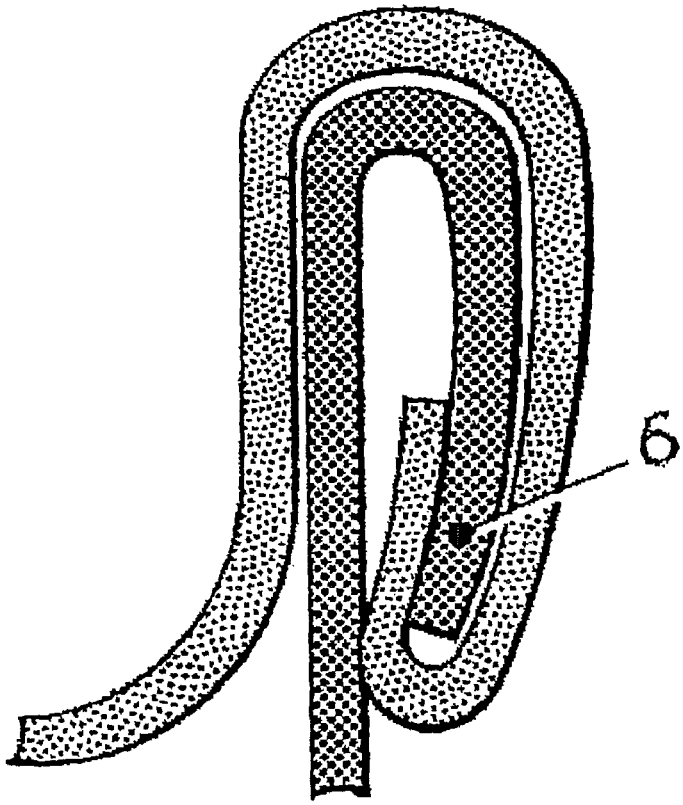

[Fig. 008]
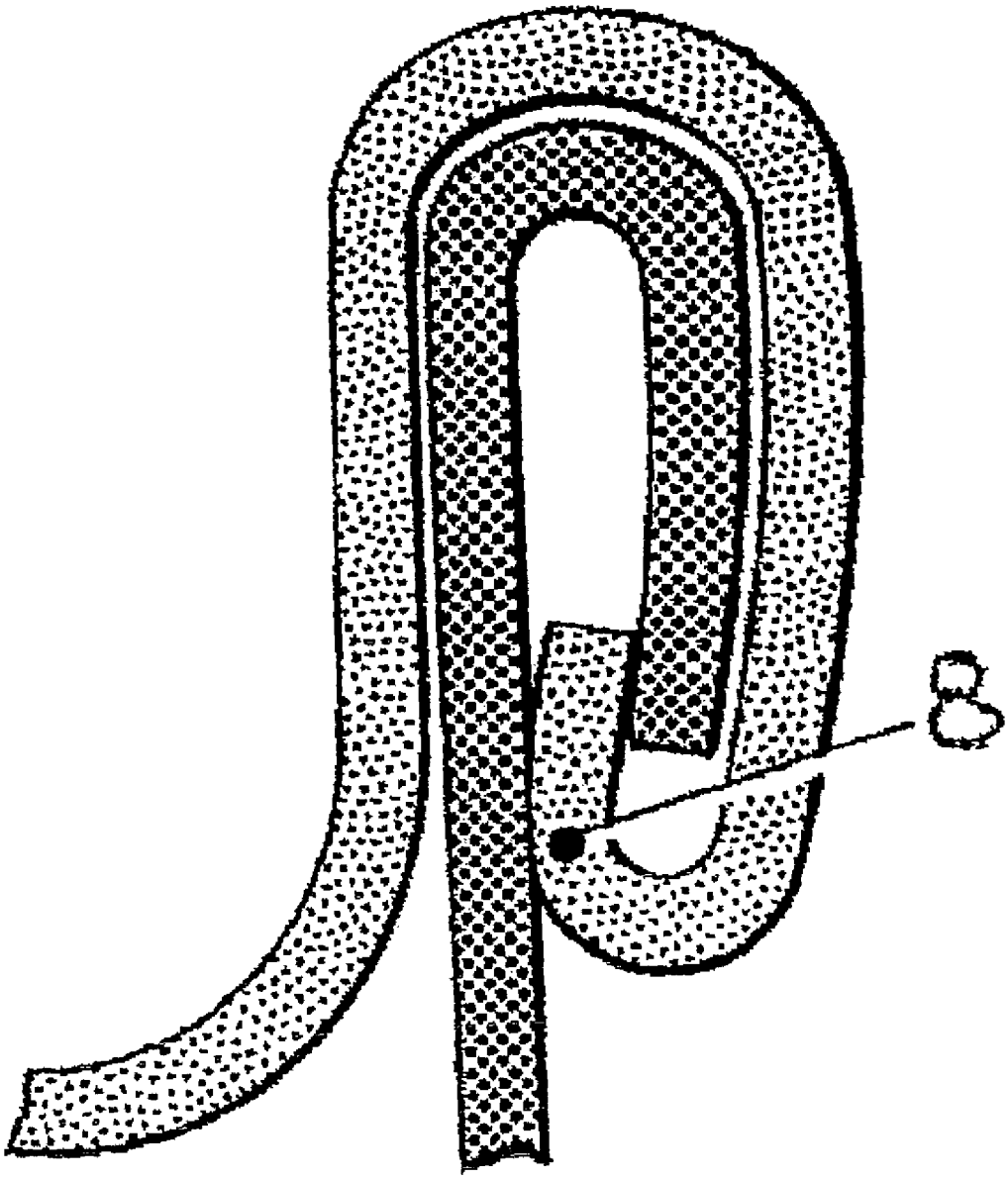

[Fig. 009]
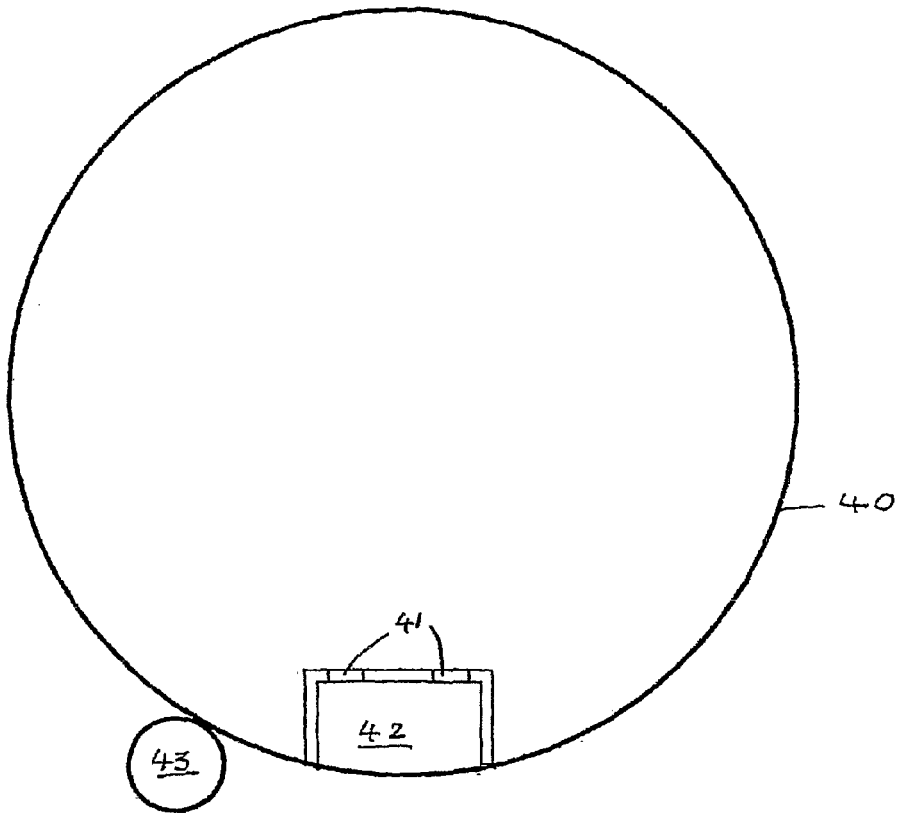
[Fig. 010]
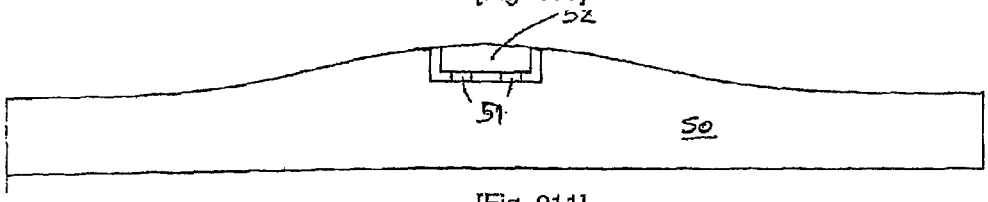
[Fig. 011]
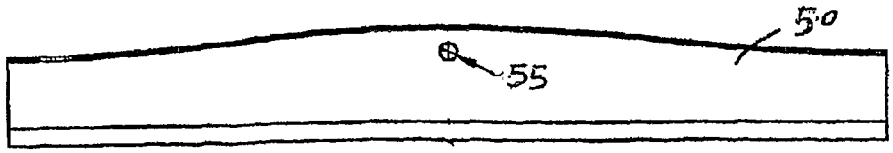

DOUBLE SEAM MONITOR

TECHNICAL FIELD

This invention relates to a double seam monitor which provides not only details of seam tightness but also predicts critical double seam parameters and gross seam defects and provides information such as machine condition.

BACKGROUND ART

A can for packaging products such as food or beverage products comprises a can body to which a can end is fixed by a process known as double seaming. This process requires first forming of a hook on the edge of the open end of the can body (the "body hook"). The curled edge of the can end is then tucked under the body hook and the two are rolled together. This forms the so-called "first operation" seam. The seaming is then completed in a "second seaming operation" in which the hooked seam formed in the first operation is ironed tight for sealing the can end and body together.

Double seam tightness monitors are known from U.S. Pat. No. 4,600,347, for example, in which part of the second operation track of a cam of a double seaming apparatus is deformable. Strain gauges monitor the deformation of this part of the cam track and the signal from the gauges is processed to identify abnormal conditions together with details of the specific force, relevant machine and date/time of each abnormal condition.

Although U.S. Pat. No. 4,600,347 provides details of the force applied during seaming so as to determine the tightness of the seam, this is limited to the second operation cycle of the seaming process in which the seam is tightened for the final seal.

This invention seeks to provide a comprehensive double seam monitor which monitors the whole seaming process from formation of the can body hook through forming of the double seam geometry by the first operation roll, to tightening of the double seam during the second operation.

DISCLOSURE OF INVENTION

According to the present invention there is provided an apparatus for monitoring a double seaming process during can manufacture or can filling, the apparatus comprising:

a lifter mechanism for lifting the can body;

first operation seaming tooling; and second operation seamer tooling;

characterised by a device for measuring the strain of and/or force applied to a the lifter mechanism by a lifter cam.

The first operation seamer tooling further includes a first operation seaming cam. The cams lift the lower lifter assembly into the seaming position, in order to apply the desired load on the cans during the entire seaming cycle By measuring strain and/or force applied to the lifter cam, the apparatus provides further information about critical seam parameters.

Preferably, the apparatus includes one or more sensors on the part of the lifter cam which corresponds to the peak of the first operation seaming operation as defined by the peak of the first operation seaming cam. In one embodiment, the sensors are mounted on a prepared portion of the lifter cam. A bridge piece which is equivalent to more than one can revolution is cut from the lifter cam and some of the underlying metal is removed. The sensor, which may comprise one or more load cells, is mounted on this prepared portion of the lifter cam.

In an alternative embodiment, the sensor may comprise a strain gauge such as a transverse or longitudinal pin-type strain gauge. In this embodiment, the lifter cam includes a hole in which the sensor is mounted. The deflection of the cam above the gauge during this part of the cycle can then be measured by the strain gauge. The sensor then converts the deflection value into a strain measurement which can then be analysed to give further information such as applied force. Strain gauges are particular easy to mount in a variety of positions, not simply at the peak of the first operation as shown here, and the information from strain reading may be used to monitor the whole seaming process. For example. When the sensors are placed on the part of the lifter cam which corresponds to the peak of the first operation cycle, the load applied during the first operation cycle provides detailed information on double seam geometry.

Although analysis of base load can be used to predict the quality of the double seam in terms of the critical parameters, commonly referred to as actual overlap, body hook butting and seam gap, the apparatus may further include one or more sensors on the seaming cam track to provide an indication of the tightness of the double seam. These sensors may be mounted on a portion of reduced wall thickness of the cam, as in U.S. Pat. No. 4,600,347, or the sensor may be in an insert in the cam track which is laterally displaceable by the cam follower.

BRIEF DESCRIPTION OF THE DRAWINGS

FIG. 1 is a schematic side section of basic seamer design;

FIG. 2 is a side section of an ideal seam after the first seaming operation;

FIGS. 3 and 4 are side sections of first operation seam defects;

FIG. 5 is a side section of an ideal seam after the second seaming operation;

FIGS. 6 to 8 are side sections of second operation seam defects;

FIG. 9 is modified seaming cam with pressure sensor;

FIG. 10 is a side view of a modified lifter cam with base load sensor; and

FIG. 11 is an alternative arrangement for the lifter cam, using a strain gauge sensor.

MODE FOR THE INVENTION

FIG. 1 shows the basic seamer design for rolling either the top or bottom end onto the can body so as to form a hermetic seal. A can body hook is first formed and the can body 1 and end 2 are clamped together by a load applied vertically to the lifter 10. In the first seaming operation, the first operation seaming roll 20, the end seaming panel 4 and can body flange 5 are rolled together and interlocked. The second operation roll 30 finishes the operation by tightening the seam.

In FIG. 1, the first operation seaming operation is shown schematically on the right hand side as part of the canner's double seam which is formed after filling the can. The second operation seam is shown as part of the maker's operation on the left hand side of FIG. 1, that is before filling.

Ideally, he first operation seam is formed as shown in FIG. 2 with can body hook 6 firmly embedded in sealing compound 7. The sealing compound extends around the end hook 8 for embedding in the final seam. If insufficient forming has taken place the first operation seam will be too loose as shown in FIG. 3. This could result in a short end hook 8, excessive seam length or end hook pleats. If the first operation seam is too tight, the seam could be out of specification due to short body hook 6, long end hook 8, or insufficient seam length.

The side section of the second operation seam should ideally look as shown in FIG. 5, in which sealing compound 7 has been omitted for clarity. FIGS. 6 to 8 exhibit various faults which may arise during the second operation seaming. For example, the body hook 6 of FIG. 6 is too short and that of FIG. 7 is too long. The end hook 8 of FIG. 8 is too short. The length of the body hook is dependent on base load, pin height (see feature 15 of FIG. 1) and/or tightness of seaming rolls.

It is known that short body hooks may be due to the first operation rolls being set too tight, the second operation rolls being set too loose or the seaming chuck 17 being too high in relation to the base plate. Conversely, a long body hook may be due to the first operation rolls being set too loose, the second operation rolls being set too tight, the seaming chuck 17 being too low in relation to the base plate, or the base plate load being too great.

In the present invention, it has been found that faults may also arise due to settings throughout the seaming process and not necessarily due to the faults outlined above. Furthermore, gross seam defects may be due to a chipped seaming chuck 17, scrap on the seaming chuck or a damaged flange 5. By monitoring the whole seaming process, greater information can be collected and analysed to prevent machine downtime or excessive scrap at the earliest possible opportunity.

A modified seaming cam 40 with load cells 41 is shown in FIG. 9. A bridge piece 42 covers the load cells when the cam is fully assembled for use. In use, the cam follower 43 passes over the bridge piece 42 and the load on the isolated bridge piece is measured by load cells 41. This type of load cell arrangement can be used in the present invention to monitor load applied by the lifter cam. In the example shown in FIG. 10, the lifter cam 50 has been modified by removal of a bridge piece at the part of the cam profile which corresponds to the peak of the first operation seaming operation. A pair of load cells 51 are positioned either side of this peak and the bridge piece 52 replaced. Load applied by the cam follower as it passes over the peak position is monitored by the load cells 51 and analysed to give information about the first operation seam.

An alternative modification to the lifter cam is shown in FIG. 11 in which a strain gauge 55 is positioned to measure strain at the peak of the first operation. The sensor in this example is positioned 15 mm below the peak and mounted in hole with a diameter of 10 mm.

In an initial trial, the pin height setting 15 (see FIG. 1) of a machine was altered and several cans were made. Changing the pin height has a significant effect on the base load applied on the cans. The sensor fitted in the lifter cam provided a good measure of the force applied to the can by the spring in the lifter assembly. Changes in base load markedly affected the body hook and overlap of the seam. Extreme situations such as skidders, in which the seam has not been fully rolled along part of the circumference, were readily detectable by a significant shift in the force measured. This situation could be set up by a very high pin height for assessment purposes.

Initial analysis also shows correlation between seaming force and base load. Furthermore, changes in base load were clearly reflected in body hook measurements. Where a series of seaming heads were monitored, differences between heads were clearly reflected in base load measurements.

Analysis of the base load data provided by the lifter cam sensor provides details of variation in the seaming process such as incoming components, fill level and machine setup, which leads to a change in seaming parameters. It can be seen that by analysing base load measurements over a period of time, information in machine condition can be obtained. In addition, gross seam defects are obtainable and can be rectified at an early stage, thus avoiding expensive down time and large numbers of scrap cans.

The invention claimed is:

1. An apparatus for monitoring a double seaming process during can manufacture or can filling, the apparatus comprising: a lifter mechanism for lifting a can body; first operation seaming tooling for a first seaming operation; second operation seaming tooling for a second seaming operation; and a sensor disposed in a lifter cam, the sensor for measuring strain of and/or force applied to the lifter mechanism by the lifter cam during the first and second seaming operations.

2. An apparatus according to claim 1, including one or more sensors on the part of the lifter cam which corresponds to a peak of the first seaming operation.

3. An apparatus according to claim 2, in which one or more sensors are mounted on a prepared portion of the lifter cam.

4. An apparatus according to claim 3, in which the sensor(s) comprise one or more load cells.

5. An apparatus according to claim 4, in which the sensor(s) are mounted on a portion of reduced wall thickness of the lifter cam.

6. An apparatus according to claim 4, in which the sensor(s) is/are in an insert in the cam track which is laterally displaceable by a cam follower.

7. An apparatus according to claim 2, in which, the sensor or sensors comprise a strain gauge.

8. An apparatus according to claim 5, in which the lifter cam includes a hole in which the sensor is mounted.

9. An apparatus according to claim 6, further including one or more sensors on the seaming cam track.

10. An apparatus according to claim 7, wherein the strain gauge is a transverse pin type strain gauge.

11. A method for monitoring a double seaming process during can manufacture or can filling, the method comprising:

(a) lifting a can body with a lifter mechanism that is moved by a lifter cam, the can body having a hook formed at an end;

(b) placing a can end having a seaming panel onto the can body;

(c) seaming the hook of the can body to the seaming panel of the can end during a first seaming operation;

(d) tightening the seam formed in step (c) during a second seaming operation; and (e) measuring strain of and/or force applied during the first and second seaming operations with a sensor that is disposed in the lifter cam.

12. A method according to claim 11, wherein one or more sensors are mounted on a prepared portion of the lifter cam.

13. A method according to claim 12, wherein the sensor(s) comprise one or more load cells.

14. A method according to claim 12, wherein the sensor(s) are mounted on a portion of reduced wall thickness of the lifter cam.

15. A method according to claim 12, wherein the sensor(s) is/are in an insert in the cam track which is laterally displaceable by a cam follower.

16. A method according to claim 12, in which, the sensor or sensors comprise a strain gauge.

17. The method of claim 11, wherein strain is measured at a peak of the first seaming operation.

* * * * *